US009464431B2

(12) United States Patent
Castonguay et al.

(10) Patent No.: US 9,464,431 B2
(45) **Date of Patent: *Oct. 11, 2016**

(54) WALL WITH DECORATIVE FACING

(71) Applicant: LES MATERIAUX DE CONSTRUCTION OLDCASTLE CANADA, INC., St-John (CA)

(72) Inventors: Bertin Castonguay, Magog (CA); Robert Daoust, Boucherville (CA)

(73) Assignee: Les materiaux de construction Oldcastle Canada Inc, St-John (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/876,871

(22) Filed: Oct. 7, 2015

(65) Prior Publication Data

US 2016/0024786 A1 Jan. 28, 2016

Related U.S. Application Data

(63) Continuation of application No. 12/752,766, filed on Apr. 1, 2010, now Pat. No. 9,206,599, which is a continuation-in-part of application No. 12/525,491, filed as application No. PCT/CA2007/002351 on Dec. 21, 2007, now abandoned.

(60) Provisional application No. 60/887,877, filed on Feb. 2, 2007.

(51) Int. Cl.

| | |
|---|---|
| ***E04B 2/30*** | (2006.01) |
| ***E04B 2/46*** | (2006.01) |
| ***E04B 2/86*** | (2006.01) |
| *E04B 2/34* | (2006.01) |
| *E04C 1/00* | (2006.01) |
| *E04B 2/02* | (2006.01) |

(52) U.S. Cl.

CPC ..... *E04B 2/46* (2013.01); *E04B 2/8641* (2013.01); *E04B 2002/0247* (2013.01); *E04B 2002/0269* (2013.01); *E04B 2002/867* (2013.01)

(58) Field of Classification Search

CPC ..... E04B 2/46; E04B 2/8641; E04B 2002/0247; E04B 2002/867; E04B 2002/0269

USPC ..... 52/426

See application file for complete search history.

(56) References Cited

U.S. PATENT DOCUMENTS

| | | | |
|---|---|---|---|
| 738,643 | A | 9/1903 | Van Camp |
| 791,291 | A | 5/1905 | Roberts |
| 1,033,988 | A | 7/1912 | Coburn |
| 1,214,964 | A | 2/1917 | Small |
| 1,226,214 | A | 5/1917 | Hopkins |
| 1,345,156 | A | 6/1920 | Flynn |
| 1,567,085 | A | 12/1925 | Rowland |
| 1,624,369 | A | 4/1927 | Serra |
| 1,907,053 | A | 5/1933 | Flath |
| 1,943,800 | A | 1/1934 | Morrison |
| 1,953,005 | A | 3/1934 | Nagel |
| 2,049,907 | A | 8/1936 | Hess |
| 2,061,822 | A | 11/1936 | Bankert |
| 2,225,612 | A | 12/1940 | Allen |
| 2,392,551 | A | 1/1945 | Roe |
| 2,544,488 | A | 3/1951 | Chittenden |
| 2,929,238 | A | 3/1960 | Kaye |
| 3,391,507 | A | 7/1968 | Downing |
| 3,546,833 | A | 12/1970 | Perreton |
| 3,607,643 | A | 9/1971 | Paget |
| 3,609,926 | A | 10/1971 | Muse |
| 3,786,605 | A | 1/1974 | Winfrey |
| 3,854,256 | A | 12/1974 | Wilce |
| 3,877,236 | A | 4/1975 | O'Neill et al. |
| 4,068,482 | A | 1/1978 | Hilfiker |
| 4,164,598 | A | 8/1979 | Wilhelm |
| 4,229,922 | A | 10/1980 | Clark, Jr. |
| 4,285,181 | A | 8/1981 | Van Loghem et al. |
| 4,391,077 | A | 7/1983 | Giess |
| 4,438,605 | A | 3/1984 | DeLucia |
| 4,478,021 | A | 10/1984 | Person |
| 4,490,075 | A | 12/1984 | Risi et al. |
| 4,498,266 | A | 2/1985 | Perreton |
| 4,532,747 | A | 8/1985 | Koetje |
| 4,545,703 | A | 10/1985 | Boynton |
| 4,589,241 | A | 5/1986 | Volpenhein |
| 4,596,102 | A | 6/1986 | Catani et al. |
| 4,597,236 | A | 7/1986 | Braxton |

| | | | |
|---|---|---|---|
| 4,655,014 | A | 4/1987 | Krecke |
| 4,774,791 | A | 10/1988 | Kafarowski |
| 4,825,619 | A | 5/1989 | Forsberg |
| 4,833,856 | A | 5/1989 | Zwagerman |
| 4,835,928 | A | 6/1989 | Scott |
| 4,866,891 | A | 9/1989 | Young |
| 4,956,949 | A | 9/1990 | Francis |
| 4,967,528 | A | 11/1990 | Doran |
| 5,033,912 | A | 7/1991 | Vidal |
| 5,161,918 | A | 11/1992 | Nodel |
| 5,214,898 | A | 6/1993 | Beretta |
| 5,315,802 | A | 5/1994 | Hart |
| 5,350,256 | A | 9/1994 | Hammer |
| 5,370,480 | A | 12/1994 | Quaney |
| 5,403,127 | A | 4/1995 | Knudsen |
| 5,435,111 | A | 7/1995 | Cox et al. |
| 5,468,098 | A | 11/1995 | Babcock |
| 5,472,297 | A | 12/1995 | Heselden |
| 5,474,405 | A | 12/1995 | Anderson et al. |
| 5,489,074 | A | 2/1996 | Arnold et al. |
| 5,501,049 | A | 3/1996 | Francis et al. |
| 5,505,563 | A | 4/1996 | Curt |
| 5,513,475 | A | 5/1996 | Schaaf et al. |
| 5,570,552 | A | 11/1996 | Nehring |
| 5,586,841 | A | 12/1996 | Anderson et al. |
| 5,647,166 | A | 7/1997 | Neff |
| 5,647,695 | A | 7/1997 | Hilfiker et al. |
| 5,688,078 | A | 11/1997 | Hammer |
| 5,707,184 | A | 1/1998 | Anderson et al. |
| 5,735,643 | A | 4/1998 | Castonguay et al. |
| 5,788,423 | A | 8/1998 | Perkins |
| 5,845,448 | A | 12/1998 | Potvin |
| 5,851,088 | A | 12/1998 | Anderson et al. |
| 5,930,947 | A | 8/1999 | Eckhoff |
| 5,934,039 | A | 8/1999 | Guy |
| 5,957,744 | A | 9/1999 | Mott et al. |
| 5,983,585 | A | 11/1999 | Spakousky |
| 6,024,517 | A | 2/2000 | Castonguay et al. |
| 6,062,772 | A | 5/2000 | Perkins |
| 6,176,059 | B1 | 1/2001 | Cantarano et al. |
| 6,189,282 | B1 | 2/2001 | VanderWerf |
| 6,238,144 | B1 | 5/2001 | Babcock |
| 6,622,445 | B1 | 9/2003 | Shillingburg et al. |
| 6,662,520 | B1 | 12/2003 | Nelson |
| 6,701,687 | B1 | 3/2004 | Shillingburg |
| 6,874,291 | B1 | 4/2005 | Weber |
| 6,880,297 | B2 | 4/2005 | Johnston |
| 6,912,823 | B2 | 7/2005 | MacDonald et al. |
| 6,935,081 | B2 | 8/2005 | Dunn et al. |
| 6,953,309 | B1 | 10/2005 | Tufts et al. |
| 6,978,581 | B1 | 12/2005 | Spakousky |
| 7,410,328 | B2 | 8/2008 | Hamel |
| 7,464,509 | B1 | 12/2008 | Brown |
| 7,503,729 | B2 | 3/2009 | Hammer et al. |
| 7,827,752 | B2 | 11/2010 | Scherrer |
| 8,206,065 | B2 | 6/2012 | Heselden |
| 8,596,926 | B2 | 12/2013 | Heselden |
| 8,689,501 | B2 | 4/2014 | Chamoux |
| 8,777,514 | B2 | 7/2014 | Heselden |
| 8,851,803 | B2 * | 10/2014 | Bott ..... E02D 29/025 405/262 |
| 9,151,051 | B2 | 10/2015 | Cossette et al. |
| 9,234,347 | B2 | 1/2016 | Cossette et al. |
| 2001/0029717 | A1 | 10/2001 | Spakousky |
| 2003/0126821 | A1 | 7/2003 | Scherer et al. |
| 2003/0159378 | A1 | 8/2003 | Johnston |
| 2003/0182011 | A1 | 9/2003 | Scherer |
| 2005/0120670 | A1 | 6/2005 | Ness et al. |
| 2006/0110223 | A1 | 5/2006 | Dawson et al. |
| 2006/0179779 | A1 | 8/2006 | Ness |
| 2007/0196184 | A1 | 8/2007 | Hammer et al. |
| 2007/0266656 | A1 | 11/2007 | Blocken |
| 2008/0057801 | A1 | 3/2008 | Duffy |
| 2008/0236084 | A1 | 10/2008 | Pontarolo |
| 2009/0013629 | A1 | 1/2009 | Boeshart |
| 2009/0041552 | A1 | 2/2009 | Hammer |
| 2009/0308011 | A1 | 12/2009 | Philippe |
| 2012/0060438 | A1 | 3/2012 | Jensen |
| 2012/0073229 | A1 | 3/2012 | Castonguay et al. |
| 2012/0117904 | A1 | 5/2012 | Bouchard et al. |
| 2013/0081353 | A1 | 4/2013 | Jensen |
| 2014/0215949 | A1 | 8/2014 | Cossette et al. |
| 2015/0218806 | A1 | 8/2015 | Cossette et al. |
| 2016/0186433 | A1 | 6/2016 | Cossette et al. |

FOREIGN PATENT DOCUMENTS

| | | |
|---|---|---|
| CA | 2258637 | 8/1999 |
| CA | 2447646 | 11/2002 |
| CA | 2485870 | 11/2003 |
| CA | 2544152 | 10/2006 |
| CA | 2550359 | 12/2007 |
| CN | 2353796 | 12/1999 |
| DE | 2549162 | 5/1977 |
| FR | 2583808 | 12/1986 |
| JP | 58156637 | 7/1983 |
| KR | 20110011074 | 2/2011 |
| WO | 2008092237 | 8/2008 |

OTHER PUBLICATIONS

U.S. Appl. No. 14/625,107, Office Action dated Feb. 10, 2016.
U.S. Appl. No. 14/994,953, Office Action dated Feb. 10, 2016.
Australian Patent Application No. 2011307995, Examination Report dated Feb. 24, 2016.
U.S. Appl. No. 14/185,214, Office Action dated May 6, 2015.
U.S. Appl. No. 14/625,107, Office Action dated Jun. 10, 2015.
U.S. Appl. No. 12/525,491, Office Action dated Apr. 21, 2014.
PCT Patent Application No. PCT/CA2014/050129, International Search Report dated May 8, 2014.
U.S. Appl. No. 13/247,633, Notice of Allowance dated Nov. 18, 2014.
Australian Patent Application No. 201107995, Examination Report dated Dec. 9, 2014.
PCT Patent Application No. PCT/CA2011/050606, International Search Report dated Nov. 4, 2011.
U.S. Appl. No. 13/247,633, Office Action dated Jan. 13, 2014.
U.S. Appl. No. 13/247,633, Office Action dated Mar. 20, 2013.
International Patent Application No. PCT/CA2007/002351, International Search Report dated Apr. 1, 2008.
Canadian Patent Application No. 2,676,369, Office Action dated Nov. 28, 2013.
U.S. Appl. No. 12/525,491, Office Action dated Aug. 29, 2013.
U.S. Appl. No. 12/525,491, Office Action dated Jul. 5, 2013.
U.S. Appl. No. 12/525,491, Office Action dated Mar. 6, 2013.
U.S. Appl. No. 13/525,491, Office Action dated Dec. 22, 2011.
U.S. Appl. No. 12/525,491, Office Action dated Jul. 19, 2011.
U.S. Appl. No. 12/752,766, Notice of Allowance dated Jul. 31, 2015.
U.S. Appl. No. 12/752,766, Office Action dated Nov. 6, 2014.
U.S. Appl. No. 12/752,766, Office Action dated Jul. 18, 2013.
U.S. Appl. No. 12/752,766, Office Action dated Jan. 18, 2013.
U.S. Appl. No. 12/752,766, Office Action dated Apr. 25, 2012.
U.S. Appl. No. 14/625,107, Notice of Allowance dated May 4, 2016.
U.S. Appl. No. 14/625,107, Supplemental Notice of Allowability dated Jul. 8, 2016.

* cited by examiner

*Primary Examiner* — Charles A Fox
*Assistant Examiner* — Joseph J Sadlon
(74) *Attorney, Agent, or Firm* — Borden Ladner Gervais LLP

(57) ABSTRACT

Disclosed is an economical and effective way of producing a double sided decorative wall using facing panels having a decorative face surface, in particular dry cast concrete panels having a regular surface structure, more preferably an embossed surface, most preferably a patterned surface.

Further disclosed are wall components and a wall kit for a double sided decorative wall. The facing panels in the wall are stacked in a back-to-back arrangement into a pair of first and second back-to-back walls, which walls are interconnected by connectors which link at least one facing panel in the first wall to at least one facing panel in the second wall for forming the double sided decorative wall. The connecting members can be in individual connectors, or a combination of connectors for linking multiple facing panels or linking facing panels at corners or curves in the wall. The connectors can be of different length to enable the construction of decorative walls of different thickness. A modular wall system for double sided decorative walls forming both straight and curved walls is also disclosed. The system uses facing panels and connectors, wherein all facing panels are of equal thickness, but may have different lengths and may have different widths. The facing panels of the modular wall system all have graduated lengths, each length being a multiple of a base length L. Thus, the facing panels have lengths of 2L, 3L, 4L, 5L etc. To facilitate the formation of walls with corners, such as right angled corners, the facing panels preferably have a depth which is equal to L or a multiple of L. Building the decorative wall of two partial walls of facing panels with intermediate connectors renders the wall more economical than the previously known walls with base blocks and facing panels suspended from the base blocks on one or both sides.

23 Claims, 5 Drawing Sheets

WALL WITH DECORATIVE FACING

This application is a Continuation Application from U.S. patent application Ser. No. 12/752,766, filed Apr. 1, 2010, which is a Continuation-in-Part Application from U.S. patent application Ser. No. 12/525,491, filed Jul. 31, 2009, which is a 371 of PCT/CA2007/002351, filed Dec. 21, 2007, which claims priority from U.S. Ser. No. 60/887,877, filed on Feb. 2, 2007, all of which are incorporated herein by reference in their entirety.

FIELD OF THE INVENTION

The present invention is generally directed toward decorative walls such as retaining walls and freestanding walls having a decorative surface. In particular, the invention is directed to modular walls with a decorative facing and components of such walls. More specifically, the present invention is directed toward walls, which have a pair of decorative surfaces.

BACKGROUND OF THE INVENTION

Retaining walls are used in landscaping around residential or commercial buildings. Retaining walls can be made of various materials, but for reasons of durability are most often either concrete structures cast in situ or walls formed of stacked courses of natural stone or masonry blocks. Concrete masonry blocks have become the most popular retaining wall components, due to their ease of manufacture, transport and handling.

Freestanding walls are often used as demarcation structures along roads, walkways or property lines. These walls can be cast in situ or modular, preferably made of stacked blocks, for added flexibility in shaping the wall.

Conventional concrete masonry blocks are generally molded in a dry cast process in which a concrete mixture is filled into a mold box and compressed to generate a pre-consolidated block. This pre-block is removed from the mold box and transported to a setting location at which the block is stored for setting of the concrete mixture. Due to the particularities of the molding process used, the pre-block can be provided with an embossed surface structure, but only on the top and bottom surfaces. Thus, this process does not allow for the molding of a dry cast concrete block with a front decorative surface. Several methods have been developed to provide hollow dry cast blocks with a textured front surface. Molding a slab including several blocks and subsequently braking the slab into individual blocks allows for the creation of an irregular, rough front surface similar to the surface of a split natural stone. Alternatively, the smooth front surface of a finished molded block can be subjected to a percussive treatment which brakes up and roughens the front surface. However, neither method allows for the manufacture of a hollow block with any decorative front surface, for example a surface having a regular surface structure, such as an embossed surface.

Thus, an economical and effective method is desired for providing a decorative finish on any building, retaining or freestanding wall, preferably on both sides of a freestanding wall.

SUMMARY OF THE INVENTION

It is therefore one object of the invention to provide an economical and effective way of producing a decorative facing surface on a wall or on wall components.

This object is achieved by a method including the steps of directly assembling decorative facing panels having a decorative face surface into a wall. Preferably, the facing panels are dry cast concrete panels having an irregular or regular surface structure, more preferably an embossed surface, most preferably a patterned, embossed surface structure. Preferably, the wall is made of stacked courses of facing panels forming a pair of walls connected in a back-to-back arrangement to expose the decorative surface of the facing panels.

Connecting decorative facing panels in a back-to-back arrangement provides several advantages. The resulting overall structure has opposite decorative facing surfaces, allowing the structure to be used as a decorative freestanding wall. In addition, the facing panels are normally intended to be mounted to a wall block and using a back-to-back arrangement of first and second facing panel walls allows for the omission of the wall block altogether, resulting in a more economical structure and permitting the construction of overall much thinner walls.

In a preferred method in accordance with the invention, a double sided decorative wall is built, preferably a retaining wall or a freestanding wall, by obtaining a plurality of facing panels respectively having a back surface and a decorative front surface, stacking the facing panels in a back-to-back orientation to form a first wall and a second wall and connecting the first and second walls for forming the double sided decorative wall by connecting at least one facing panel in the first wall with a least one facing panel in the second wall. The facing panels are preferably dry cast concrete panels, preferably with an embossed decorative surface, more preferably with an embossed, patterned decorative front surface.

The connecting is preferably achieved by obtaining a connector for fastening the facing panels to preferably removably, to one another. Preferably, the connector is attached first to the first wall and subsequently to the facing panel of the second wall. Preferably, at least every second facing panel of the first wall is connected with at least one facing panel in the second wall. It is preferred that the majority of the facing panels in the first wall are respectively connected with at least one facing panel in the second wall. Most preferably, every facing panel in the first wall, is connected with at least one facing panel in the second wall.

In another aspect, the invention provides a wall kit for a double sided decorative wall. The kit preferably includes at least a first facing panel having a back surface and a decorative front surface, at least a second facing panel having a back surface and a decorative front surface, and a connector for connecting the first and second facing panels in a back-to-back arrangement to form a double sided, decorative wall component.

Preferably, each facing panel has a retaining recess in its back surface and the connector has at least a pair of interlocking members for each engaging the retaining recess in one of the facing panels to connect the facing panels in a back to back arrangement. Most preferably, each facing panel further has a second retaining recess in the rear surface, and the connector has at least one second interlocking member for engaging the second retaining recess in one of the facing panels. The retaining recesses are preferably keyhole slots and the connector preferably has a central web with opposite, terminally positioned enlarged portions forming the first and second interlocking members respectively, with each interlocking member shaped and constructed for interlocking engagement with a keyhole slot.

In a further aspect, the invention provides a double sided decorative wall. The wall includes a plurality of stacked facing panels, preferably dry cast concrete panels, each decorative facing panel having a back surface and a decorative front surface, preferably an embossed decorative front surface. The facing panels are stacked in a back-to-back arrangement for forming a pair of first and second back-to-back walls. The wall further includes connectors for connecting at least one facing panel in the first wall to at least one facing panel in the second wall for forming a double sided decorative wall.

In yet another aspect, the invention provides a modular wall system for a double sided decorative wall. The modular wall system includes individual stackable wall components in the form of the facing panels discussed above and connectors for connecting the wall components in a back to back arrangement. The facing panels are of equal thickness, but may have different lengths, and widths. The facing panels of the wall system all have graduated lengths, each length being a multiple of a base length L which is equal to a base height of the panels. Thus, the panels have lengths of 2L, 3L, 4L, 5L etc. (2H, 3H, 4H, 5H . . . ). The panels preferably all have the same base height H, but panels having a height which is a multiple of the base height may also be used together with the base height panels. To facilitate the formation of walls with corners, such as right angled corners, the back-to-back arrangement preferably has an overall thickness which is equal to a multiple of L, most preferably 2L. The facing panels of the modular wall system are stackable in rows and each include at least one retaining groove in a back surface and each connector preferably has a body and opposing first and second interlocking members for respectively engaging a retaining groove in one of the facing panels for interconnecting the facing panels in the back-to-back arrangement.

In an alternate embodiment, the length of the connectors is variable to permit the selection of a desired spacing between the first and second partial walls. The resulting space between the back to back facing panel walls can be filled with loose materials such as gravel or soil or setting materials, such as concrete.

The wall in accordance with the invention can be built in situ, and preferably uses only the facing panels as wall components and their connectors. The connecting members are preferably constructed with multiple connecting ends to engage at least a pair of facing panels in a back-to-back arrangement. The connecting ends can be joined by interconnecting webs, preferably oriented in a crossing arrangement to provide lateral stability to the back-to-back arrangement.

In still another embodiment, the invention provides a kit for forming a freestanding wall having a pair of decorative facing surfaces. The kit includes facing panels which are stackable for forming a wall, and have a decorative surface and connectors for connecting the facing panels in a back-to-back arrangement.

BRIEF DESCRIPTION OF THE DRAWINGS

Preferred embodiments of the invention will now be further described by way of example only and with reference to the attached drawings, wherein.

DETAILED DESCRIPTION

Before explaining the present invention in detail, it is to be understood that the invention is not limited to the preferred embodiments contained herein. The invention is capable of other embodiments and of being practiced or carried out in a variety of ways. It is to be understood that the phraseology and terminology employed herein are for the purpose of description and not of limitation.

Figure 1:
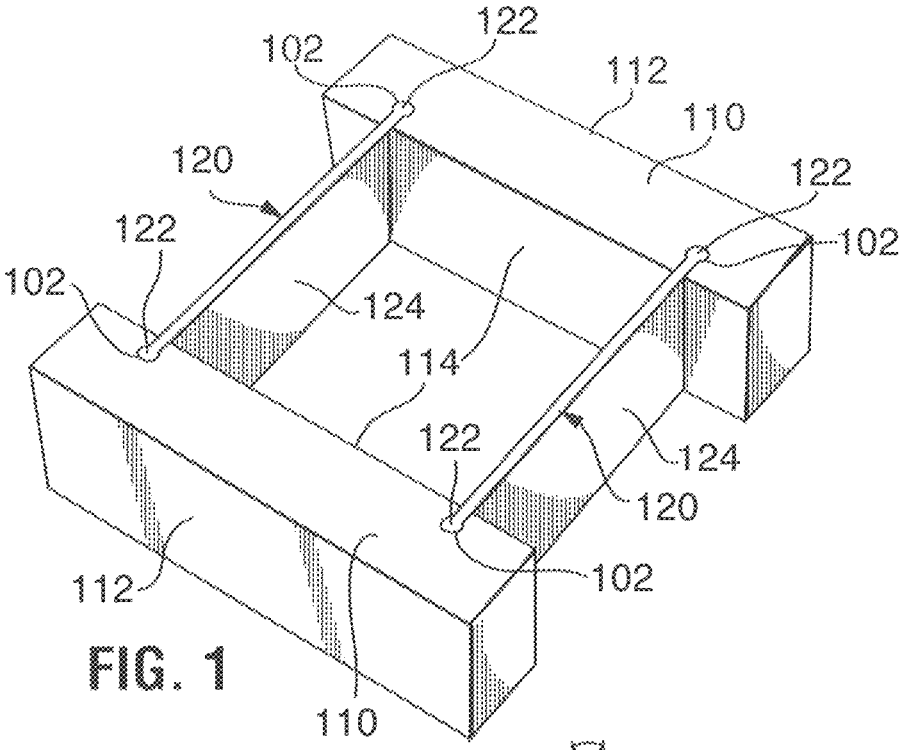
FIG. 1 illustrates a pair of facing panels connected back-to-back to form a hollow wall with double sided decorative finish.

FIG. 1 illustrates the method in accordance with the invention of providing a decorative wall 100, such as a retaining wall or freestanding wall, by connecting pairs of facing panels 110 having a decorative surface 112 in a back-to-back arrangement. In the illustrated embodiment, each facing panel 110 is connected by way of connectors 120, with at least one other facing panel. The connectors respectively engage at least two facing panels. The preferred connectors 120, which are discussed in more detail with reference to FIGS. 3*a*-3*c*, 7 and 8 have at least a pair of spaced apart parallel, cylindrical stems 122 connected by an intermediate web 124. The stems 122 form interlocking members, which engage and are reliably held in keyhole slots 102 respectively provided in the rear face 114 of the facing panels 110. The connectors 120 are preferably inserted first into the keyhole slots 102 in one facing panel. This allows the installer to mount the second facing panel 110 by sliding it onto the already installed connector. The wall is preferably made of stacked facing panels 110 as illustrated. The weight of the facing panels 110 can be supported on a footing of the wall (not shown), or on a separate footing for each partial wall formed by the facing panels 110 of one side of the double sided decorative wall. For ease of use, the connectors 120 are preferably symmetrical, which means the cylindrical stems 122 are identical in cross-section and size, but non-symmetrical variants with stems 122 of different diameter and cross-sectional shape can also be used.

Figure 2A:
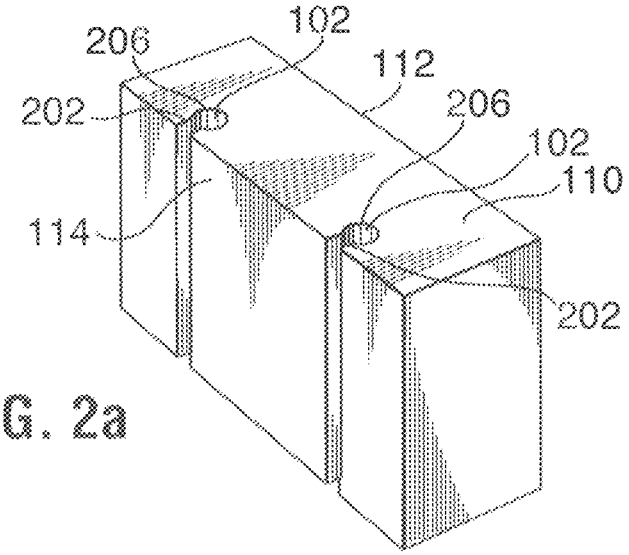
FIG. 2*a* is a perspective view of a facing panel for use in a wall in accordance with the invention.

FIG. 2*a* illustrates a facing panel 110 for use in a wall in accordance with the invention. The facing panel 110 is a dry cast concrete block which was compressed in the top to bottom direction during manufacture and has a top surface 112 and a bottom surface 114. The facing panel 110 preferably has an embossed decorative surface 112, more preferably an embossed, patterned surface. The facing panel 110 has at least one keyhole slot 102, preferably a pair of spaced apart parallel keyhole slots 102, in its bottom surface 114 (bottom surface during molding of the panel). Each keyhole slot 102 has a slot portion 202 penetrating the back surface 114 of the facing panel 110 and a cylindrical bore portion 206 connected thereto. The stems 122 of the connectors 120 are respectively inserted into the keyhole slots 206 to mount the facing panels 110 in a back-to-back arrangement (see FIG. 1). The facing panel 110 is preferably sized and shaped to permit stacking into a continuous wall 100.

Figure 2B:
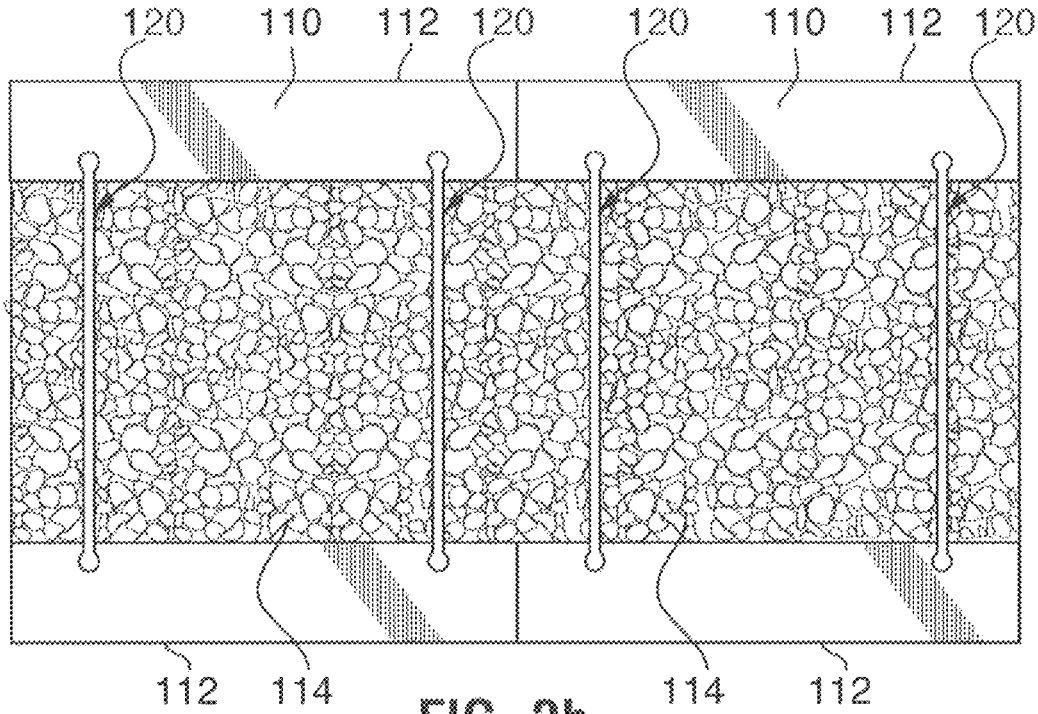
FIG. 2*b* is a schematic top view of the decorative wall of FIG. 1 with facing panels connected in a back-to-back arrangement, and filled with gravel.

FIG. 2*b* illustrates the method in accordance with the invention for providing a wall 100 with a double-sided decorative finish 112. FIG. 2*b* is a schematic top view of a decorative wall 100 in accordance with the invention including two pairs of decorative facing panels 110 arranged side-by-side with each pair connected by connectors 120 to the other pair in a back-to-back orientation. Each facing panel 110, preferably a facing panel intended for providing a decorative finish on a wall or wall block, is provided with an embossed decorative facing surface. The decorative wall 100 is preferably made of a multitude of facing panels 110 stacked in rows to form a pair of spaced apart walls connected in space apart back-to-back orientation by the intermediate connections 120. The facing panels 110 are arranged in the back-to-back orientation so that all outside surfaces of the resulting wall 100 have a decorative finish. Facing panels 110 are dry cast concrete blocks which were compressed in the top to bottom direction during manufacture, but are mounted with their bottom surfaces 112 facing one another in the decorative wall 100 so that the top surface 114 of the facing panel 110 is facing outward in the wall and thereby forms the new facing surface(s) of the wall 100.

Multiple facing panels 110 as shown in FIGS. 1, 2*a*, 4, 5*a* to 5*c* and 6 can be used to build a decorative wall 100. The decorative facing panels 110 are thereby stacked in rows, preferably staggered for additional stability, to form a decorative wall. For maximum installation flexibility and ease of handling, the decorative panels are preferably handled in the disassembled condition, which means some facing panels 110 are first separately stacked to form a partial first wall and then the facing panels are subsequently connected back-to-back to the already stacked panels to form a partial second wall spaced apart from the first partial wall and connected thereto by the connectors 120. For that purpose, the invention provides a kit for a decorative wall, which kit includes a number of facing panels and connectors for connecting the facing panels back-to-back. The interconnection of the back-to-back facing panels is preferably carried out on a row by row basis, as each row of facing panels is finished, so that the connectors need not be forced through the keyhole slots of more than one panel. In the alternative, only the insertion of the connectors into one partial wall is done on a row by row basis. However, this will require moving facing panels for the other partial wall along several connectors, which may increase the time required for installation of the complete wall. Jumper panels can be included in the wall, which are larger in size than the remaining panels and possibly rotated by 90°. When jumper panels of the same principle construction as the surrounding panels are used, which are rotated by 90°, the facing panel back-to-back thereto is preferably installed immediately after placement of the jumper panel and before the rows of panels around the jumper panel are finished. Sliding of the facing panel onto the connector in the jumper panel may no longer be possible once the connectors of the adjoining panels are installed, due to their orientation perpendicular thereto. However, where jumper panels are used which have keyhole slots oriented 90° to those of regular panels, installation of the facing panel back-to-back onto the jumper panel can be carried out in the ordinary course of installation since the slots in the jumper panel are then parallel to those in the surrounding panels. For added stability of the decorative wall, the connectors can be inserted into the keyhole slots so that they engage the facing panels in vertically adjacent rows of facing panels and thereby not only connect the first and second walls, but also stacked rows.

Figure 4:
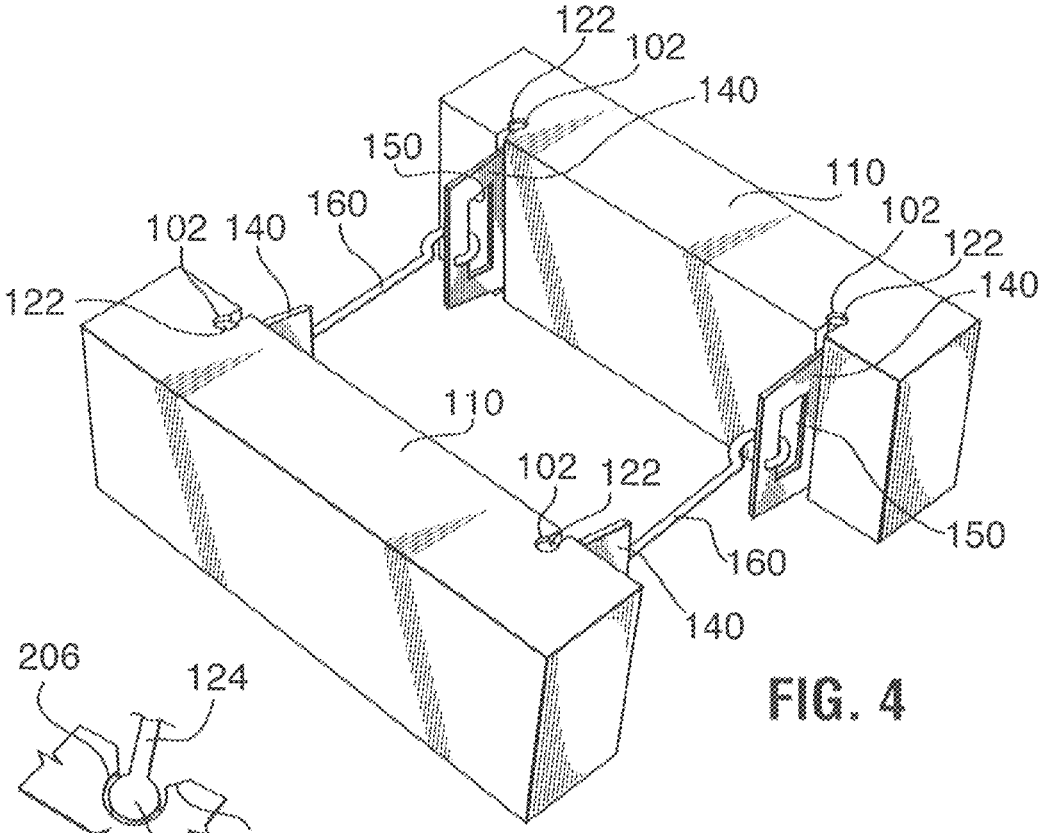
FIG. 4 is a top perspective view of decorative wall components in accordance with the invention including a pair of decorative panels connected back-to-back with a modular connector system.

FIG. 4 shows an alternate method of connecting the facing panels of the respective partial walls by using base connectors 140 which each engage only one facing panel 110, but include an opening or eyelet 150 for engagement by a hook-shaped link 160, which may be of adjustable length (not illustrated) and is shaped and constructed to engage a base connector 140 at each end. Alternatively, the link 160 may incorporate one base connector 140 at one end.

Figure 5B:
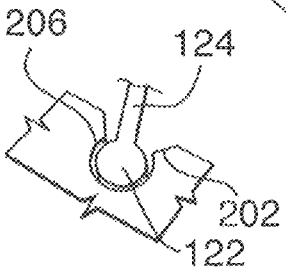
FIGS. 5*a* to 5*c* are perspective top views of decorative wall components in accordance with the invention including a pair of decorative facing panels connected back-to-back with an X-shaped connector.
Figure 5C:
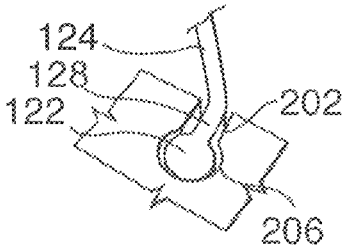
Figure 5A:
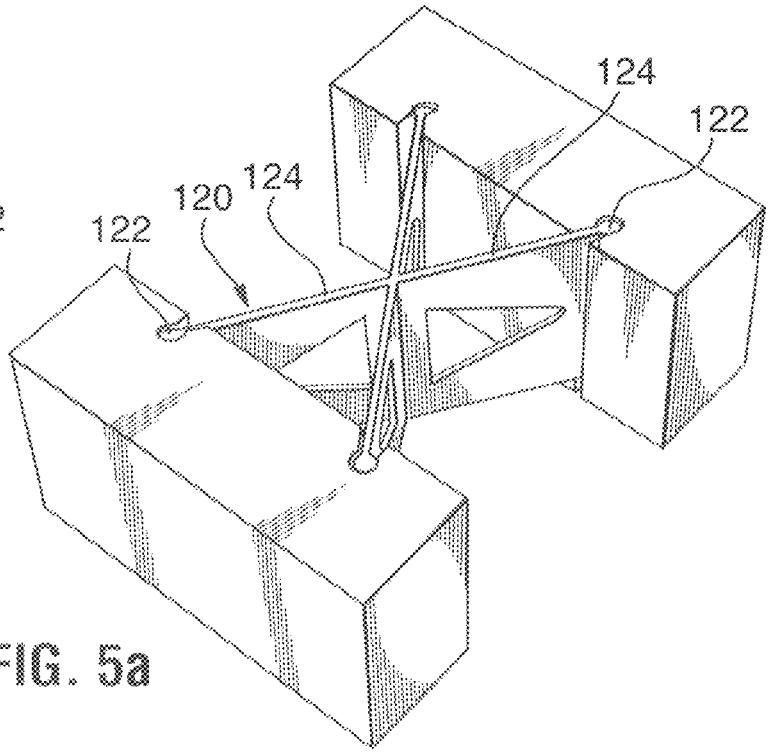

As illustrated in FIGS. 5*a* to 5*c*, the keyhole slots 102 in the back surface of the facing panels 110 may be shaped to interface with a Y or X-shaped connector 120 (see FIGS. 5*a* to 5*c* and 6) having webs 124 which are oriented at an acute angle to the rear surface 114 of the facing panel 110 when the connector and facing panel are interengaged. To accommodate the orientation of the webs 124, the slot portion 202 of the keyhole slots 102 in the rear surface 114 of the facing panels are tapered inwardly, thereby forming an outwardly widening V-groove in the rear surface 114 (see FIG. 5*b*). Alternatively, the webs 124 of the X and Y-shaped connectors 120 may be crimped adjacent their stems 122 with the crimped portion 128 oriented to engage a slot portion 202 with parallel side walls (see FIG. 5*c*).

The keyhole slots 102 in the facing panels 110 will now be discussed in more detail with reference to FIG. 2*a*. Each keyhole slot 102 has a slot portion 202 penetrating the rear surface 114 of the facing panel 110 and a cylindrical bore portion 206 connected thereto. The cylindrical bore portion 206 is sized and shaped for receiving one of the interconnecting members of the connectors, the stems 122 (see FIGS. 3*a*-3*c*). The slot portion 202 is sized and shaped for receiving the web 124 of the connector 120 (see FIGS. 3*a*-3*c*), the width of the slot portion 202 being less than the diameter of the stem 122 in order to prevent the connector 120 being pulled out of the keyhole slot 102. For maximum flexibility in connecting the facing panels 110 to one another, the facing panels preferably have a pair of retaining slots 102 in the rear surface 114. When multiple keyhole slots 102 are provided, the slots are preferably parallel and equidistantly spaced on the rear surface 114 of the facing panels 110. The slots are preferably oriented vertically or horizontally and centered on the panels when in the installed condition. Although other orientations of the slots are possible those orientations may make assembly of the decorative wall more challenging. The keyhole slots 102 preferably extend completely across the rear surface 114 to the facing panel 110. However, closed end keyhole slots 102 can also be used (not illustrated).

Figure 3C:
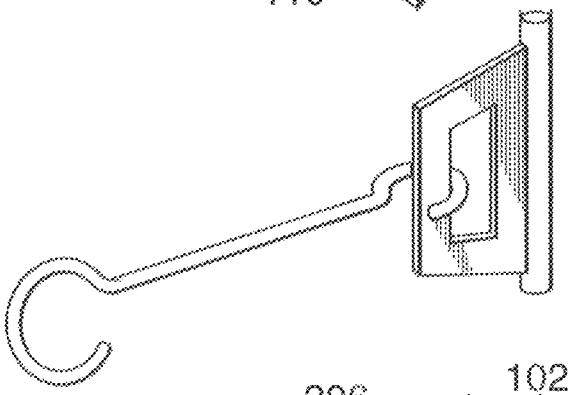
FIGS. 3*a* to 3*c* show different exemplary spacers in accordance with the invention.
Figure 3A:
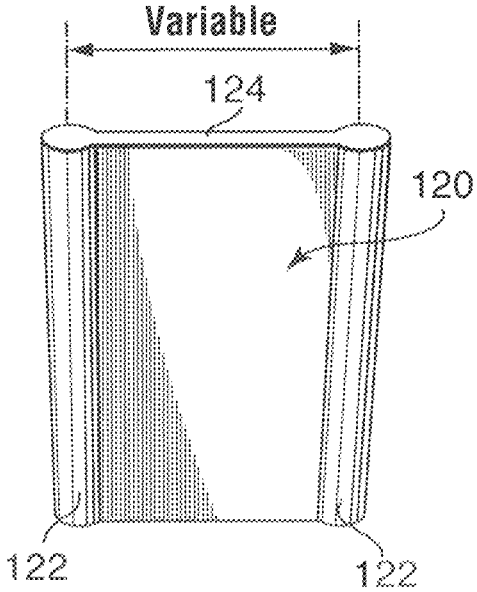
Figure 3B:
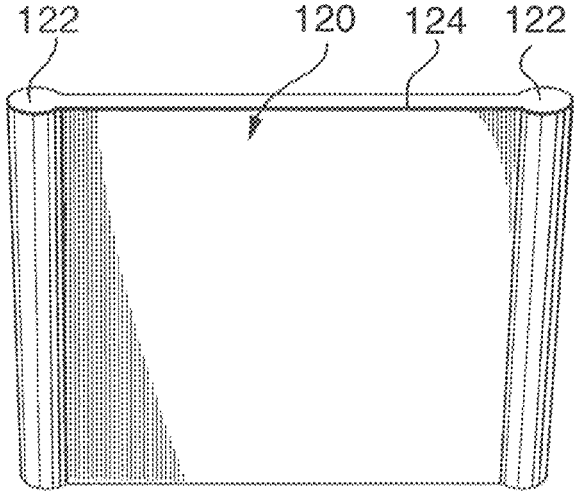

FIGS. 3*a*-3*c* show connectors of different construction. FIG. 3*a* illustrates the principle connector 120 in accordance with the invention, which is preferably of symmetrical construction to facilitate its use in the decorative wall of the invention in different orientations. The connector 120 includes a planar web 124 with opposite ends 125, 126 and a stem portion 122 at each of the ends. The stem portion 122 is preferably cylindrical, for interfacing with the keyhole slots 102 in the facing panels, but can be of any shape with allows engagement with the retaining recess in a facing panel and prevents the connector being pulled out of the retaining recess. FIG. 3*b* shows a variant of the connector shown in FIG. 3*a*, wherein the web 124 is longer than the height of the connector. This long connector is particularly suited for fillable decorative walls. The short connector of FIG. 3*a* is suited for thin decorative walls with little spacing between the back-to-back panels.

FIG. 3*c* shows a base connector 140 shown in FIGS. 3*a* and 3*b* which is a variant of connector 160, wherein only one end of the web 112 is provided with a stem 122 and the web 112 is further provided with an opening or eyelet 150 for engagement by a link 160, preferably of adjustable length (not shown). This allows the back-to-back connection of facing panels wherein the keyhole slots are staggered in the opposing blocks and, thus, not sufficiently aligned to permit the use of connectors 120 of planar construction. This base connector 140 in combination with link 160 is especially advantageous for the building of curved decorative walls, wherein, due to the spacing between the partial walls of facing panels, the keyhole slots 102 in the panels of one partial wall are misaligned with those in the other partial wall.

The connectors 120 can be made of any material sufficiently strong to reliably connect the facing panels 110 of the partial walls. The connectors are preferably made of any material which will be resistant to deterioration upon exposure to the elements, soil, gravel and the like. The most preferred material is plastic, although non-corroding metal alloys or metal connectors with a non-corroding surface finish can also be used.

Although all the preferred connectors 120, 140 described herein include interlocking members in the form of the cylindrical stems 122 intended for being mounted to the facing panels 110 by sliding them along the keyhole slots 102, connectors with stems of different cross-section can also be used, the only requirement being that the stems have a shape and thickness which prevents the connection being pulled out of the keyhole slot in which it is engaged. Furthermore, connector and retaining groove combinations other than those particularly exemplified can be used without deviating from the present invention. For example connectors of the snap in type can be used (not shown).

Of course, it will be readily apparent to the art skilled person that a retaining structure other than keyhole slots can be provided in the panels 110 as long as a reliable interlocking engagement between the retaining structure and the connectors respectively used is ensured. For example, the retaining structure can be in the form of a slot or bore and the connector can be a compressible/expandable connector which is insertable into the slot or bore and locks in the slot or bore when fully inserted in order to reliably retain the connector in the slot.

Figure 6:
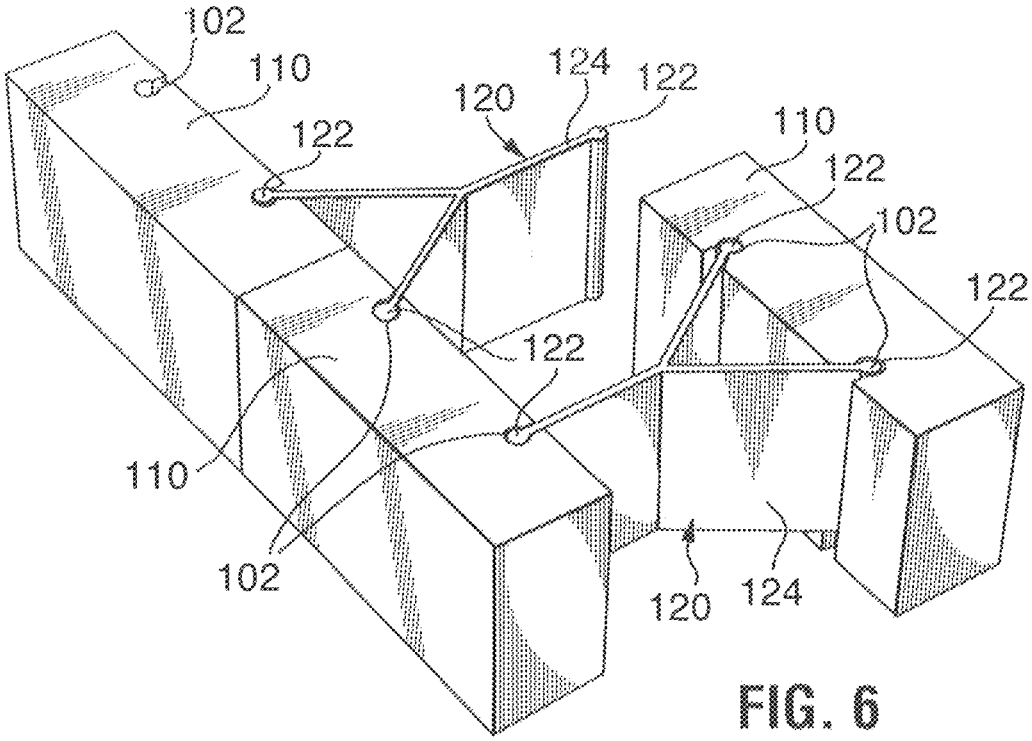
FIG. 6 is a perspective top view of a position of an exemplary wall in accordance with the invention having decorative facing panels on both sides and Y-shaped connectors.

FIG. 6 illustrates a wall in accordance with the invention including facing panels 110 and connectors 120. However, the connectors have three webs 124 which are arranged in a Y orientation and each include a stem 122 for interfacing with a keyhole slot 102 in a facing panel 110. Y-shaped connectors provide two advantages, they provide the wall with lateral stability against shifting and they allow the connection of side-by-side facing panels 110 by inserting the stem 122 on each of the forked of the connector into a keyhole slot of a different one of a pair of side by side panels. This provides added strength to the wall and reduces buckling of the partial walls of facing panels.

Figure 7:
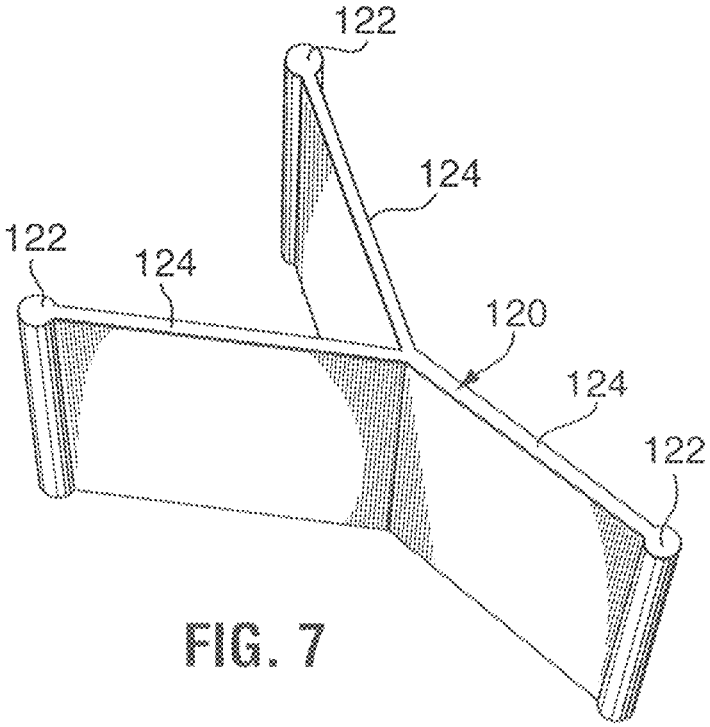
FIG. 7 illustrates a Y-shaped connector in accordance with the invention.

FIG. 7 illustrates a Y-shaped connector as shown in use in FIG. 6, wherein all three webs are of the same length and each include a cut-out or opening 129, the structural purpose of which will be discussed in more detail in relation to FIG. 9 below. Of course, providing the opening 129 also reduces the amount of material used for the connector, thereby reducing its unit cost. The webs 124 may also be of different length, with the webs in the forked end either being of equal length, for straight walls, or of different length, for curved walls (not illustrated).

Figure 8:
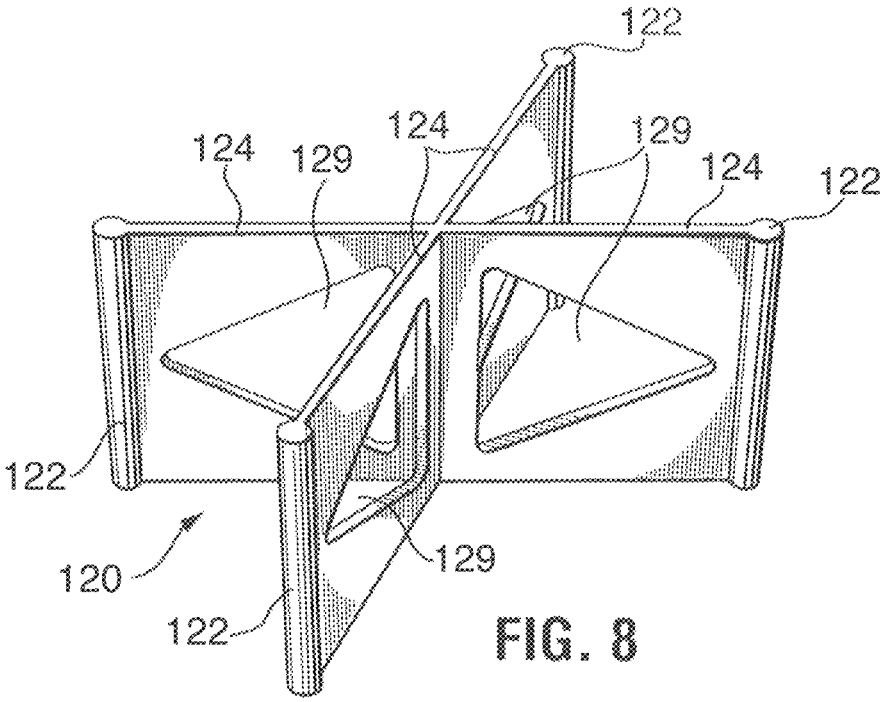
FIG. 8 illustrates an X-shaped connector in accordance with the invention.

FIG. 8 illustrates an X-shaped connector 120 in accordance with the invention. The connector includes a pair of intersecting webs 124 which each include a stem 122 at their respective ends for interconnection with a retaining recess or keyhole slot 102 in a facing panel 110. The pair of stems 122 respectively located on opposite sides of the intersection can be engaged in the same facing panel 110 or respectively in one keyhole slot of laterally adjacent panels. As with the Y-shaped connector, each web 124 is preferably provided with a cut-out or opening 129.

Figure 9:
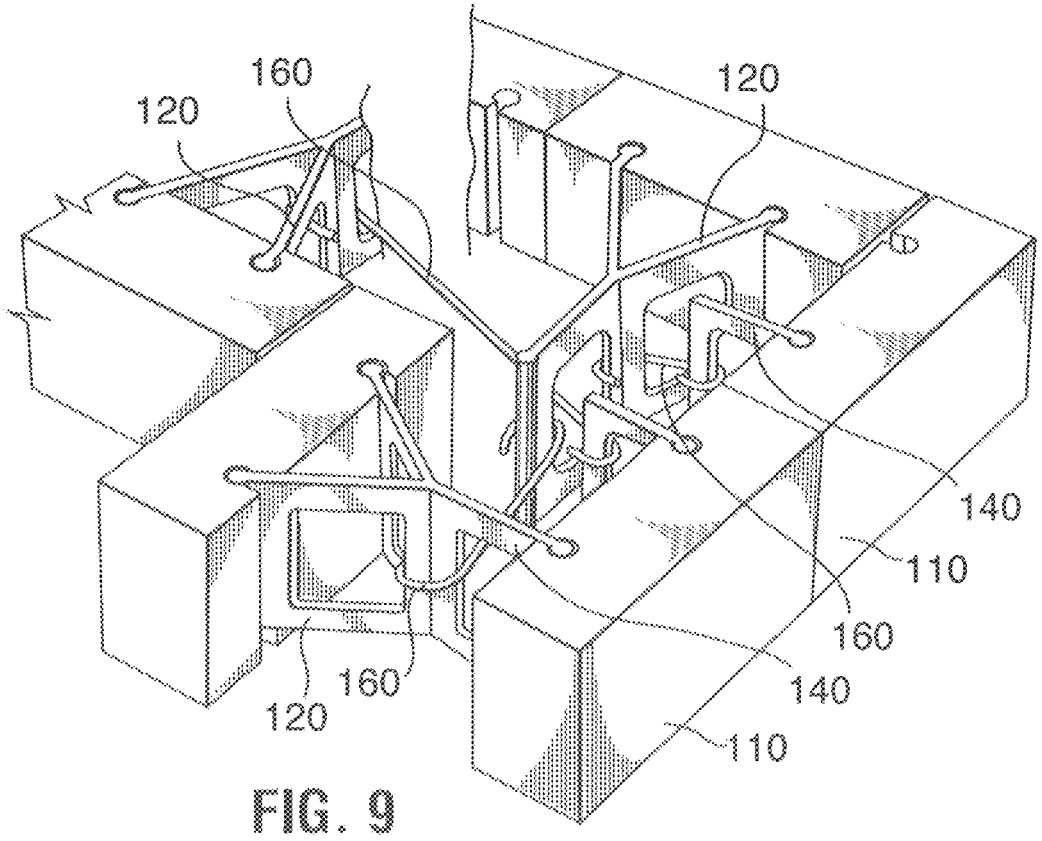
FIG. 9 schematically illustrates a corner construction using facing panels and connectors, in accordance with the invention.

FIG. 9 schematically illustrates an exemplary corner arrangement of a double sided decorative wall in accordance with the invention. As is apparent, the facing panels 110 are stacked to form a corner in each of the parallel partial walls. Y-shaped connectors 120 are used as well as base connectors 140 and links 160 to provide multi-directional stability to the corner arrangement, in an effort to prevent buckling of the respective partial walls of facing panels. Maximum stability is achieve by placing the connectors 120, 140 into the keyhole slots of vertically adjacent rows of facing panels (not illustrated) in order to connect subsequent layers in each wall with one another.

The facing panels 110 are preferably provided with a bevel at their lateral ends in order to allow for a closer fit of the facing panels in curved wall applications. The curvature of the wall can then be adjusted by using facing panels of different length, longer panels being used in the outer partial wall of the decorative wall. Generally, the shorter the blocks, the tighter the radius that can be created.

While the invention has been described with a certain degree of particularity, it is understood that the invention is not limited to the embodiments set forth herein for purposes of exemplification, but is to be limited only by the scope of the attached claims, including the full range of equivalency to which each element thereof is entitled.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A method for providing a double sided hollow wall, comprising the steps of providing a plurality of concrete facing panels having a front surface and an opposite, back surface, the back surface including at least one retaining groove;

stacking the concrete facing panels back-to-back in spaced apart parallel rows to form a pair of spaced apart parallel first and second wall components and an intermediate space;

connecting each concrete facing panel in the first wall component with at least one concrete facing panel in the second wall component in the back-to-back orientation to form the double sided wall; and bridging a first concrete facing panel in the first wall component with at least one second concrete facing panel in the second wall component by using a branched connector for providing the double sided wall with stability against shifting of the first and second concrete facing panels parallel to one another, the branched connector being generally Y-shaped with a first connecting end and an opposite branched end, the branched end having at least a pair of second connecting ends, the step of bridging including attaching the first connecting end to the at least one retaining groove in the first concrete facing panel and attaching each of the second connecting ends to at least one retaining groove of the at least one second concrete facing panel.

2. The method of claim 1, wherein each retaining groove is shaped as a keyhole slot.

3. The method of claim 2, wherein each connecting end has an enlargement for fittingly engaging the keyhole slot.

4. The method of claim 1, further comprising the step of adding a loose filler material in the intermediate space.

5. The method of claim 1, wherein the step of bridging includes connecting each of the second connecting ends to a retaining groove in separate, but adjacent second concrete facing panels.

6. The method of claim 1, further comprising the step of forming a corner in the double sided hollow wall by connecting a third connector having orthogonal, opposite ends with a pair of adjacent concrete facing panels in the first or second wall component in a substantially right angle orientation to one another.

7. The method of claim 1, wherein the first connecting end of the branched connector is branched into a pair of first connecting ends and the step of bridging includes attaching the pair of first connecting ends to the at least one retaining groove in the first concrete facing panel.

8. The method of claim 1, wherein the first connecting end of the branched connector is branched into a pair of first connecting ends and the step of bridging includes attaching the pair of first connecting ends to the at least one retaining groove in a pair of adjacent first concrete facing panels.

9. A wall kit for a double sided hollow wall, comprising a plurality of concrete facing panels, each having a front surface and an opposite back surface with at least one retaining groove, and a plurality of first connectors for connecting the plurality of concrete facing panels in back-to-back, spaced apart parallel rows to form a pair of spaced apart parallel first and second wall components with an intermediate space, wherein said first connectors have opposite connecting ends for respectively removably engaging the retaining groove of one of the back-to-back facing panels in the first and second wall components, and at least one generally Y-shaped, branched connector for bridging a first concrete facing panel in the first wall component with at least one second concrete facing panel in the second wall component, the branched connector having a first connecting end and an opposite branched end, the branched end having at least a pair of second connecting ends for removable engagement of the first connecting end with the retaining groove in the first concrete facing panel and removable engagement of each of the second connecting ends with at least one retaining groove of the at least one second facing panel.

10. The wall kit of claim 9, wherein each retaining groove is shaped as a keyhole slot.

11. The wall kit of claim 9, wherein each connecting end has an enlargement for fittingly engaging the keyhole slot.

12. The wall kit of claim 9, further comprising a loose filler material for placement in the intermediate space.

13. The wall kit of claim 9, further comprising a third connector for forming a corner in the double sided hollow wall, the third connector having orthogonal, opposite ends for attachment to a pair of adjacent concrete facing panels in the first or second wall component in a substantially right angle orientation to one another.

14. The wall kit of claim 9, wherein the first connecting end of the branched connector is branched into a pair of first connecting ends for attachment to the at least one retaining groove in the first concrete facing panel.

15. The wall kit of claim 9, wherein the first connecting end of the branched connector is branched into a pair of first connecting ends for attachment to the at least one retaining groove in a pair of adjacent first concrete facing panels.

16. A double sided hollow wall, comprising a plurality of concrete facing panels, each concrete facing panel having a front surface and an opposite back surface with a retaining groove;

the facing panels being stacked side-by-side and in a spaced apart back to back arrangement for forming back-to-back and spaced apart parallel first and second wall components with an intermediate space;

a plurality of first connectors respectively connecting the retaining groove in a concrete facing panel in the first wall component to the retaining groove in at least one concrete facing panel in the second wall component to form the double sided hollow wall; and at least one generally Y-shaped, branched connector for bridging a first concrete facing panel in the first wall component with at least one second concrete facing panel in the second wall component, the branched connector having a first connecting end and an opposite, branched end, the branched end having a pair of second connecting ends, the first connecting end being attached to the retaining groove in the first concrete facing panel and each of the second connecting ends being attached to at least one retaining groove of the at least two second concrete facing panels.

17. The double sided hollow wall of claim 16, wherein each retaining groove is shaped as a keyhole slot.

18. The double sided hollow wall of claim 16, wherein each connecting end has an enlargement for fittingly engaging the keyhole slot.

19. The double sided hollow wall of claim 16, further comprising a loose filler material in the intermediate space.

20. The double sided hollow wall of claim 16, wherein each of the second connecting ends is attached to a retaining groove in separate, but adjacent second concrete facing panels.

21. The double sided hollow wall of claim 16, further comprising a corner wherein a third connector having orthogonal, opposite ends is connected with a pair of adjacent concrete facing panels in the first or second wall component oriented at a substantially right angle to one another.

22. The double sided hollow wall of claim 16, wherein the first connecting end of the branched connector is branched into a pair of first connecting ends respectively attached to the at least one retaining groove in the first concrete facing panel.

23. The double sided hollow wall of claim 16, wherein the first connecting end of the branched connector is branched into a pair of first connecting ends for attachment to the at least one retaining groove in a pair of adjacent first concrete facing panels.

* * * * *